United States Patent [19]

Fortney

[11] Patent Number: 4,637,811

[45] Date of Patent: Jan. 20, 1987

[54] CONTAINER DIE SYSTEM

[75] Inventor: Joe L. Fortney, Gas City, Ind.

[73] Assignee: Peerless Machine & Tool Corporation, Marion, Ind.

[21] Appl. No.: 787,732

[22] Filed: Oct. 15, 1985

[51] Int. Cl.[4] ..... B31B 1/44

[52] U.S. Cl. ..... 493/167; 264/294; 425/398; 493/152; 493/902

[58] Field of Search ..... 493/152, 154, 167, 169, 493/170, 338, 339, 902; 264/294, 296; 425/398; 72/348

[56] References Cited

U.S. PATENT DOCUMENTS

| | | | |
|---|---|---|---|
| 4,149,841 | 4/1979 | Patterson | 425/398 |
| 4,246,223 | 1/1981 | Patterson | 264/292 |
| 4,427,476 | 1/1984 | Beck et al. | 264/296 |
| 4,514,353 | 4/1985 | Alexander et al. | 264/294 |

*Primary Examiner*—Lowell A. Larson
*Assistant Examiner*—Robert Showalter
*Attorney, Agent, or Firm*—Barnes & Thornburg

[57] ABSTRACT

An apparatus and method is provided for simultaneously forming at least two interconnected deep-drawn containers in a single sheet of paper stock or the like. The apparatus includes a female die assembly formed to include a material-receiving cavity situated between spaced-apart first and second container-forming cavities. A blade assembly pushes a portion of the single sheet downwardly into the material-receiving cavity to provide a source of excess paperboard material from which the paper for adjacent containers can be drawn. A male die assembly moves to engage the female die assembly and draw at least the excess paperboard material deposited in the material-receiving cavity to form containers in the first and second container-forming cavities. A draw ring holds the sheet against the female die assembly during operation of the male die assembly. The apparatus and method are usable to simultaneously draw a pair of containers joined together by a hinged section so that one container can be folded about an axis over the other container to provide a clamshell container assembly.

13 Claims, 10 Drawing Figures

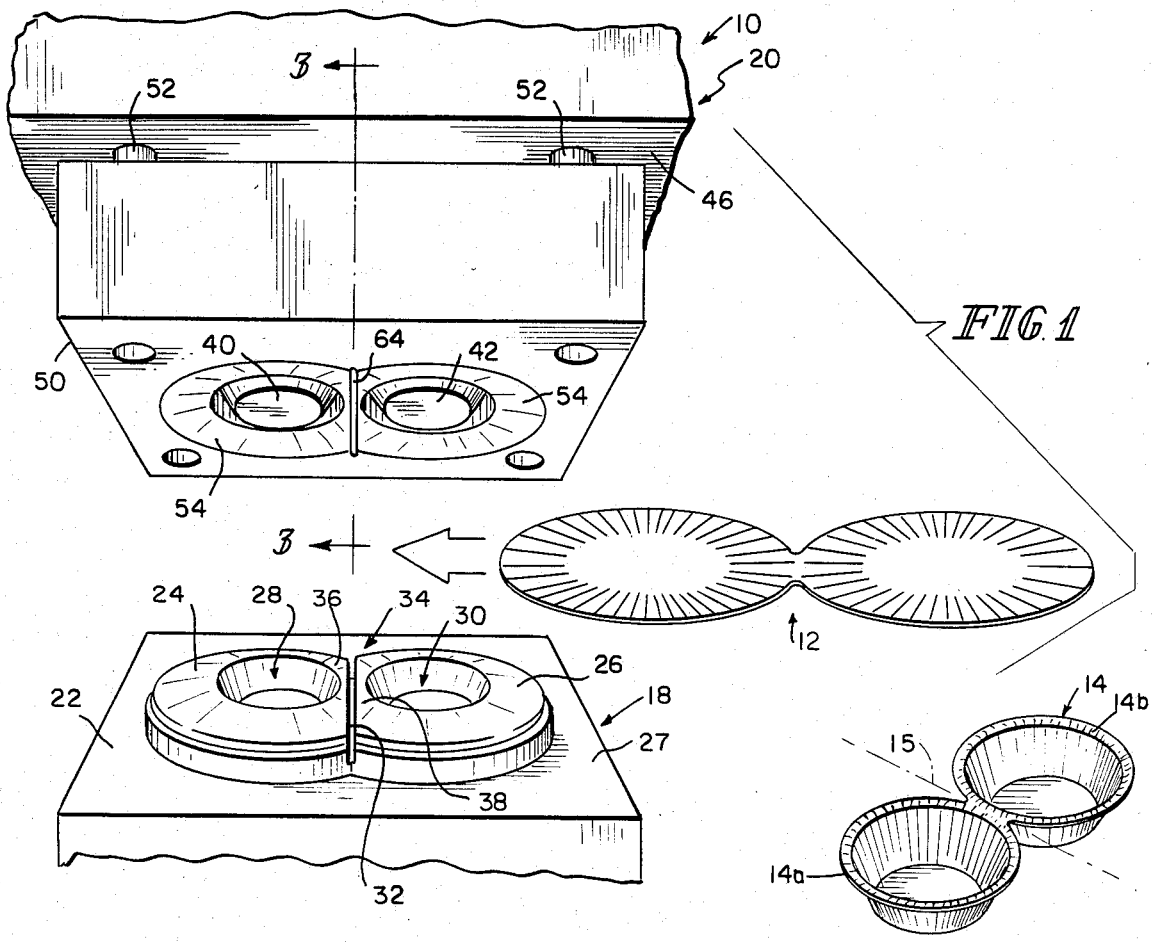
FIG. 1
FIG. 2
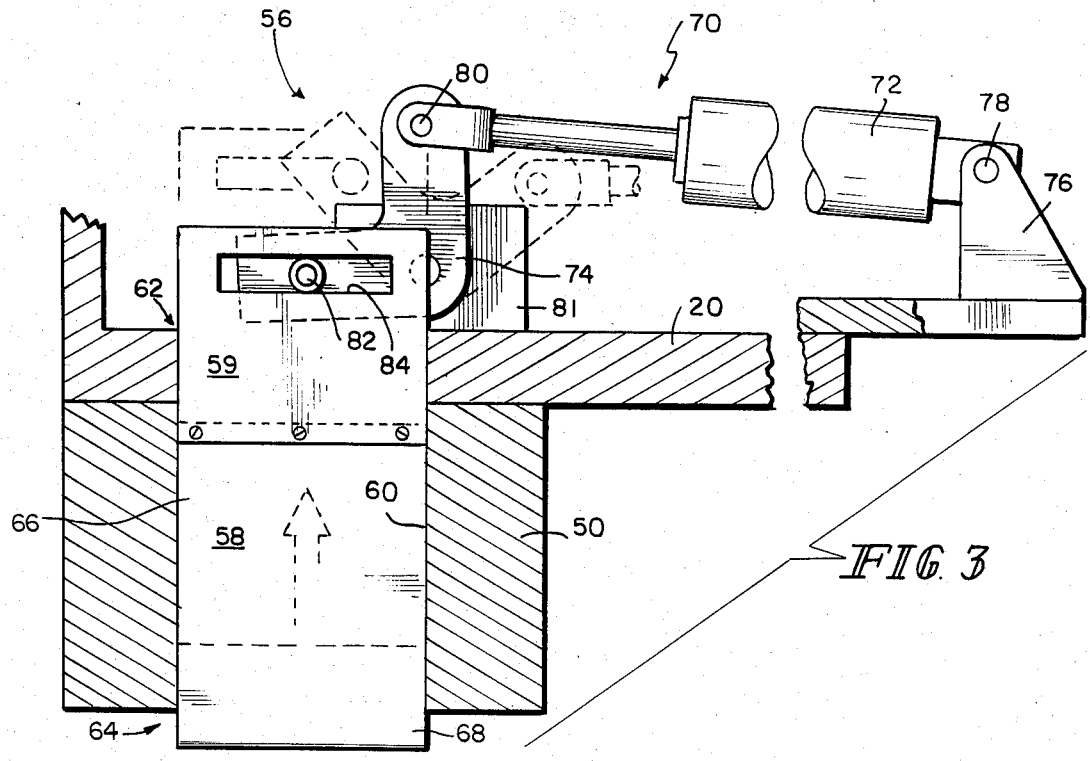
FIG. 3

CONTAINER DIE SYSTEM

The present invention relates to a system for producing a plurality of containers from a single blank of paperboard material or the like, and particularly to a system for simultaneously deep drawing at least two interconnected containers from a single blank.

In the art of constructing containers by drawing paperboard or the like in a press, it has been difficult to draw simultaneously more than one container from a single blank without tearing, rupturing, or otherwise damaging the common regions interconnecting adjacent containers. This manufacturing problem has forced container producers to use complex, expensive alternative container-forming apparatus and techniques. One alternative is to form containers sequentially in a blank rather than simultaneously. In addition to the long cycle time required to form a series of individual containers in sequence, complex sequential presses are needed to accomplish such a task. Another alternative is to form containers out of a material such as expanded foam, polystyrene, or the like. It will be appreciated by those skilled in the art that the printability and consumer acceptance of containers formed of such materials is much less than that of paperboard containers. An apparatus and method for simultaneous formation of multiple containers in a single blank of paper stock would avoid undesirable shortcomings of known machines and processes.

In forming a clamshell-type container assembly of the type having a pair of adjacent deep-drawn containers interconnected by a common hinged section, it is particularly important to avoid tearing or ripping the common hinged section so that one of the adjacent containers can be folded over the other container to provide a large chamber for storing the articles. Clamshell container assemblies are particularly popular in the fast-food restaurant industry and the heat-and-serve food industry. In addition, it is desirable to avoid tearing any of the many common regions interconnecting adjacent containers in a lattice arrangement of a plurality of interconnected deep-drawn containers. Such lattice arrangements provide container assemblies resembling muffin tins or the like and provide convenient means for packaging a plurality of individual food items or the like. The inability to draw simultaneously a plurality of interconnected containers from a single sheet of relatively inexpensive paper stock has been a barrier to the development and use of paperboard in the clamshell and lattice-type container-forming industry.

One object of the present invention is to provide an apparatus and method for simultaneously forming a pair of deep-drawn paperboard containers joined together by an integral common hinged section from a single sheet of paper stock so that one container can be folded about an axis over the other container to provide a clamshell container assembly.

Another object of the present invention is to provide an apparatus and method for simultaneously forming a plurality of interconnected paperboard containers from a single blank, each pair of adjacent containers being joined together by a common region so as to provide a lattice of interconnected deep-drawn containers.

In accordance with the present invention, an improved apparatus is provided for simultaneously forming at least two interconnected deep-drawn containers in a single sheet of paper stock or the like. The improved apparatus includes a female die assembly formed to include spaced apart first and second container-forming cavities, a drawing surface extending therebetween, and a material-receiving cavity formed in the drawing surface in between the container-forming cavities, a blade assembly for pushing a portion of the single blank of sheet material downwardly into the material-receiving cavity to provide a source of excess paperboard material from which the paper for adjacent containers can be drawn, and a male die assembly for drawing the blank and also the excess paperboard material deposited in the material-receiving cavity to form containers in the first and second container-forming cavities. In addition, a draw ring is provided for holding the blank of sheet material against the female die assembly during operation of the male die assembly to prevent wrinkling of the drawn paperboard.

In preferred embodiments of the present invention, the blade assembly includes a knife blade receivable in the material-receiving cavity and actuating means for moving the knife blade between projected and retracted positions. Illustratively, an air cylinder and bell crank linkage coact to project the knife blade downwardly into the material-receiving cavity to deposit a portion of the blank material therein prior to formation of the containers and to retract the knife blade from its projected position to permit blank material deposited in the material-receiving cavity to be drawn therefrom during operation of the male die assembly.

The female die assembly further includes first and second drawing surfaces interconnecting the material-receiving cavity and each of the first and second container forming cavities, respectively. Illustratively, the draw ring is configured to lie adjacent to the material-receiving cavity and to surround the periphery of each of the container-forming cavities when lowered to its blank-gripping position. Thus, movement of the male die assembly to engage the female die assembly acts to draw excess material from the material-receiving cavity through a passage between the lowered draw ring and the opposite drawing surfaces to avoid wrinkling in the common region interconnecting the adjacent deep-drawn containers.

Also in accordance with the present invention, an improved method is provided of simultaneously forming at least two containers with a common region extending between each pair of adjacent containers in a single blank. Illustratively, the method includes the steps of pushing a portion of the single blank loaded in a press into a material-receiving cavity situated between two spaced apart container-forming female die sections to provide a reservoir of excess blank material, holding the blank between a draw ring and the female die sections, and moving a male die assembly to engage the female die assembly thereby drawing excess blank material from the material-receiving cavity through a passage between the draw ring and the female die sections so that excess blank material is conducted from the material-receiving cavity toward at least one of the container forming cavities during movement of the male die section. Using this novel technique, a plurality of interconnected containers are formed substantially simultaneously without tearing, rupturing, or otherwise damaging the common regions between each pair of adjacent containers.

One feature of the present invention is the provision of the material-receiving cavity underneath the blank to be converted and the companion blade assembly above the blank to be converted. Advantageously, the common region interconnecting the two adjacent containers is configured using the novel apparatus and method to serve as a source of excess paper from which the paper for the adjacent containers can be drawn. The blade is projected downwardly into the material-receiving cavity before the single blank is gripped by the draw ring so that excess paper can be deposited in the material receiving cavity without weakening or otherwise thinning the remaining undeposited portion of the single blank loaded in the press. Unless the common region interconnecting the two adjacent containers is formed to include such a source of excess paper in accordance with the present invention prior to formation of the containers, the paper material in the common region is typically stretched beyond its elastic limit during drawing operations resulting in paper rupture, tearing, or the like. Advantageously, the apparatus and method of the present invention acts to form such a paper source or reservoir in said common region to overcome such a tearing problem and to make feasible simultaneous formation of a plurality of interconnected deep-drawn containers in a single blank of paper stock or the like. Additional advantages of paperboard containers in comparison to alternative materials such as expanded foam, polystyrene, or the like include improved printability and wider consumer acceptance.

Another advantage of the apparatus and method of the present invention is that adjacent containers can be formed in closer proximity to one another than was heretofore possible since provision of the paper reservoir in the common region interconnecting adjacent containers makes it unnecessary to increase the width of a common region substantially over the minimum commercially acceptable dimension (as is customary in the art). Typically, overly wide common regions are selected to provide a sufficient volume of paper in that region in an attempt to minimize the likelihood of rupture due to paper stretching. However, such a compensatory design strategy has met with little success in the industry.

Many advantages result from substantially simultaneous formation of a plurality of interconnected, deep-drawn containers. Simultaneous forming results in a faster cycle time in comparison to the cycle time achievable using known techniques of sequential forming. In addition, die complexity (e.g. camming, linkage, and actuator assemblies and controls) is reduced since the various moving die assemblies need no longer be moved in sequence, but, rather, are operated simultaneously.

Additional objects, features, and advantages of the invention will become apparent to those skilled in the art upon consideration of the following detailed description of preferred embodiments exemplifying the best mode of carrying out the invention as presently perceived. The detailed description particularly refers to the accompanying figures in which:

FIG. 1 is a perspective view of a preferred embodiment of an apparatus for performing the method of the present invention showing a die blank about to be loaded into a press die system;

FIG. 2 is a perspective view of a pair of interconnected containers formed simultaneously using the press die system, shown in FIG. 1;

FIG. 3 is an enlarged, fragmentary sectional view taken generally along lines 3—3 of FIG. 1 showing a knife blade assembly in a projected position, a retracted position of the knife blade assembly being illustrated in broken lines;

Figure 4:
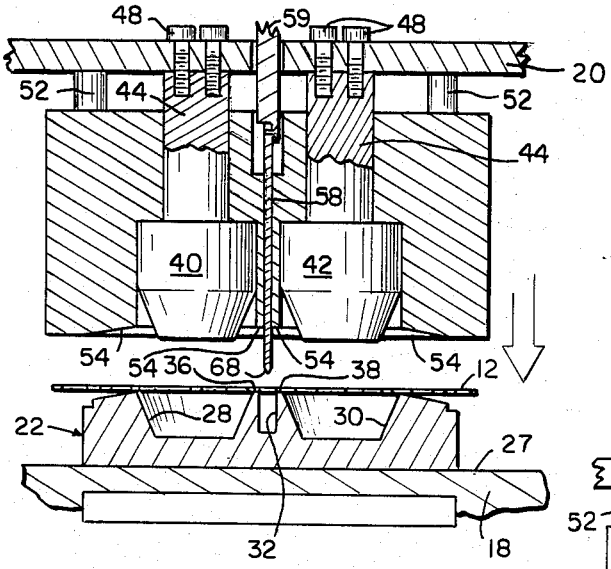
FIG. 4 is a transverse sectional view of the apparatus of FIG. 1 with portions broken away showing the die press in an initial position at the beginning of a die cycle.

The press die apparatus 10 of FIG. 1 is used to convert a single blank 12 into a pair of interconnected, deep-drawn containers 14*a*, b of the type shown in FIG. 2. Once formed the containers 14*a, b* are joined together by a common hinge section so that container 14*a* can be folded about transverse axis 15 over the other container 14*b* to provide a clamshell container assembly 14. Preferably, the blank 12 is precut from a single sheet of paperboard to have a figure-8 shape and is scored as shown in FIG. 2. It would also be possible to start with a rectangular-shaped board that is trimmed to a desired peripheral shape after completion of container formation. Reference is hereby made to U.S. Pat. No. 4,149,841 to Patterson for a more complete discussion of various features and advantages of a scored blank of the type suitable for use in press die apparatus 10.

The press die apparatus 10 includes a stationary platen 18 and a movable platen 20. A female die assembly 22 having a first die section 24 and a second die section 26 is affixed to an upwardly-facing surface 27 of the stationary platen 18. Each female die section 24, 26 is formed to include a centrally located container-forming cavity 28, 30, respectively. It will be understood that the shape of one or both of the illustrated cavities can be varied significantly to suit the size of articles to be received therein during use of the containers without substantially affecting the function and operation of the apparatus and method of the present invention.

An upwardly-opening transverse slot 32 is formed in the female die assembly 22 to bifurcate a common drawing region 34 extending between the container-forming cavities 28, 30. The transverse slot 32 is situated between the container-forming cavities 28, 30 and underneath the blank 12 to receive a small portion of the blank 12 in the manner explained below once during each press cycle prior to formation of the adjacent containers. The transverse slot 32 divides the common drawing region 34 into first and second drawing surfaces 36, 38 extending between the transverse slot 32 and the first and second container-forming cavities 28, 30, respectively.

Referring now to FIGS. 1 and 4, a pair of male die sections 40, 42 is rigidly fixed to spaced plunger rods 44 that are rigidly attached to a downwardly-facing surface 46 of movable platen 20 by bolts 48. Each male die section 40, 42 is suitably configured to engage its underlying companion container-forming cavity. Conventional means (not shown) is provided to drive male die sections 40, 42 downwardly so that both sections engage the female die assembly substantially simultaneously to form interconnected containers 14 in the container-forming cavities at about the same time.

A movable draw ring 50 acts to clamp the single blank 12 against the female die assembly 22 during container-forming operations to reduce wrinkling of the drawing containers. The movable draw ring 50 is reciprocably supported on guide rods 52. The draw ring 50 includes a pair of downwardly facing contoured clamping surfaces 54 configured to engage complementary surfaces on the female die assembly 22, and, in particular, the first and second drawing surfaces 36, 38 on either side of transverse slot 32 when the draw ring 50 is lowered to its blank engaging position as shown best in FIG. 6. It will be understood that the male die sections 40, 42 and the draw ring 50 can be driven independently in a predetermined sequence using a variety of known means (not shown), including, but not limited to, a gravity-feed system, a preloaded spring system, a hydraulic system, or a pneumatic system, etc . . . Reference is again made to U.S. Pat. No. 4,149,841 to Patterson for a description of one such known drive system.

Referring now to FIGS. 3–6, a blade assembly 56 is provided for pushing a central portion of the blank 12 into the material-receiving cavity 32 formed in the female die assembly 22. Thus, a reservoir of excess paperboard material is provided for use in later drawing operations. The blade assembly 56 includes a knife blade 58 mounted on a blade support 59 for reciprocating movement in a vertical slot 60 formed in the movable platen 20 and the draw ring 50. The vertical slot 60 has an upper opening 62 in the movable platen 20 and a lower opening 64 in the draw ring 50 facing toward the material-receiving transverse slot 32 as shown best in FIG. 3. The blade support 59 extends through the upper slot opening 62. The knife blade 58 includes a proximal end 66 connected to blade support 59 and a distal blank-engaging end 68 extendable through the lower opening 64 and into the transverse slot 32.

The blade assembly 56 further includes actuator means 70 for moving the knife blade 58 between its projected position (represented by solid lines in FIG. 3) and its retracted position (represented by broken lines in FIG. 3). In the illustrated embodiment, the actuator means 70 includes an air cylinder 72 and a pivoting bell crank linkage 74. The air cylinder 72 has one end that is pivotally journaled to a fixed mounting bracket 76 at pivot 78 and the other end pivotally journaled to the bell crank linkage 74 at pivot 80. The bell crank linkage 74 is pivotally journaled to fixed pivot block 81 and includes a pin 82 that is slidably received in a transverse pin-receiving slot 84 formed in an exposed portion of the blade support 59.

As shown in FIG. 3, expansion of air cylinder 72 pivots the bell crank linkage 74 about pivot block 81 in such a way as to apply a downwardly-directed force to the knife blade 58 via the sliding pin 82 and the transverse pin-receiving slot 84 in the blade support 59. This downwardly-directed force acts to move the knife blade 58 in a downwardly direction in vertical slot 60 causing the distal end 68 of the knife blade 58 to intercept the blank underlying 12 positioned on the female die assembly 22 and press a portion of that blank 12 into the material receiving transverse slot 32. The air cylinder 72 is contractible to retract the knife blade 58 from such a projected position to permit material received in the transverse slot 32 to be emptied therefrom during subsequent drawing steps.

Figure 5:
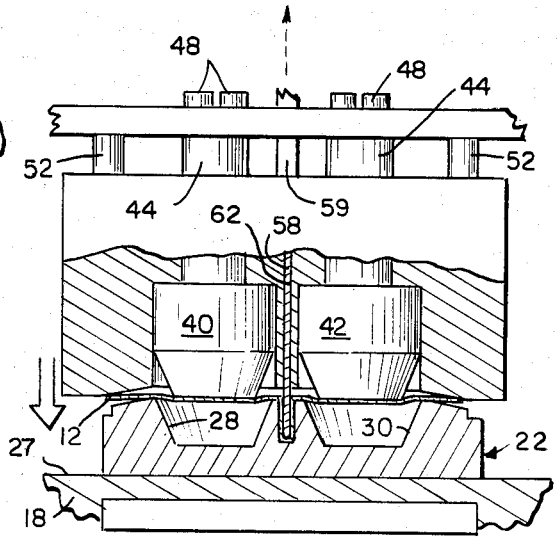
FIG. 5 is a sectional detail view similar to that of FIG. 4 showing the knife blade in its projected position prior to formation of the containers.

In operation, one cycle of the press die 10 is illustrated in FIGS. 4–7 and described in the following paragraphs. First, the knife blade 58 pushes a portion of the paperboard blank 12 shown in its initial position in FIG. 4 into the transverse slot 32 as shown in FIG. 5 to form a groove and a hinge section filled with excess paper material for the subsequent container-forming steps. At this point, the draw ring 50 is not in contact with the female die assembly 22 so that the paper stock is able to flow freely into the slot 32 in response to urging pressure applied by the knife blade 58.

Figure 6:
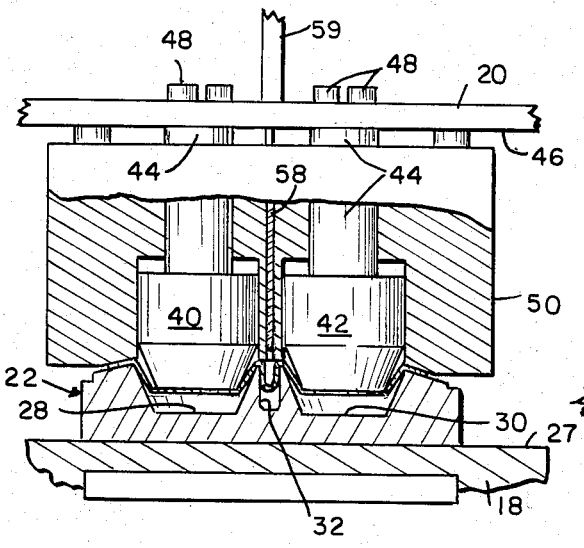
FIG. 6 is a sectional detail view similar to FIGS. 4 and 5 showing deposition of a portion of the blank in a central material-receiving cavity of the die system during one stage of container formation.
Figure 7:
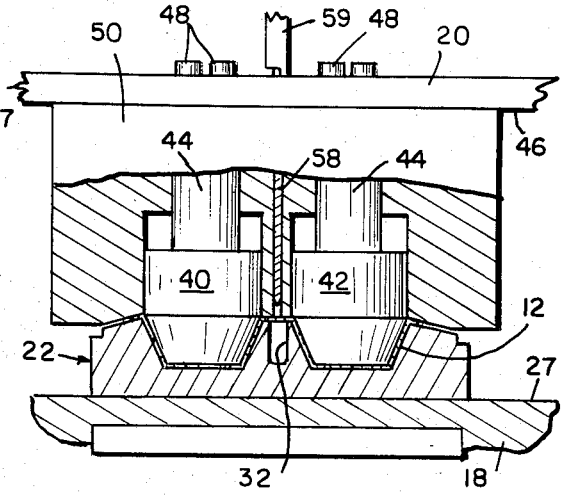
FIG. 7 is a sectional detail view similar to that of FIGS. 4–6 showing an emptied material-receiving cavity at a subsequent final stage of container formation.

The knife blade 58 is withdrawn from the slot 32 before any container forming begins so that paper stock deposited in the slot 32 can be drawn out of the slot 32 in response to operating the male die sections 40, 42. Once the blade 58 is withdrawn from the transverse slot 32, the draw ring 50 is actuated to move the downwardly-facing clamping surfaces 54 to engage the blank 12 as shown in FIG. 6. At the same time, the first and second male die sections 40, 42 are urged into respective container-forming cavities 28 and 30 to begin drawing both containers simultaneously. Continued movement of the male die sections 40, 42 to a lowest depth in the container forming cavities 28, 30 causes substantially all of the excess paper stock material to be emptied from the transverse slot 32 as shown in FIG. 7. The excess stock is drawn between certain inner portions of the downwardly-facing surfaces 54 of the draw ring and the first and second drawing surfaces 36, 38 of the female die assembly toward the first and second container-forming cavities 28, 30. Once the foregoing drawing operation is complete, the draw ring 50 and the male die sections 40, 42 can be returned to their initial lifted position shown in FIG. 4 and the deep-drawn pair of interconnected containers ejected to prepare the press die apparatus 10 for the beginning of a subsequent press cycle.

Figure 8:
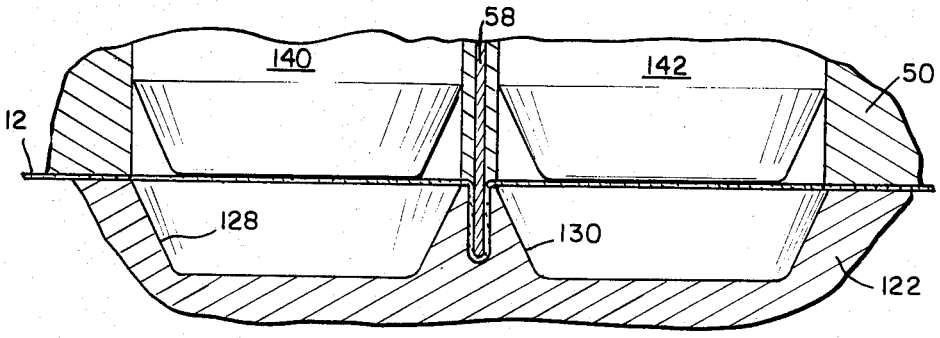
FIG. 8 is a side elevation view of another embodiment of an apparatus for performing the method of the present invention with portions broken away.
Figure 9:
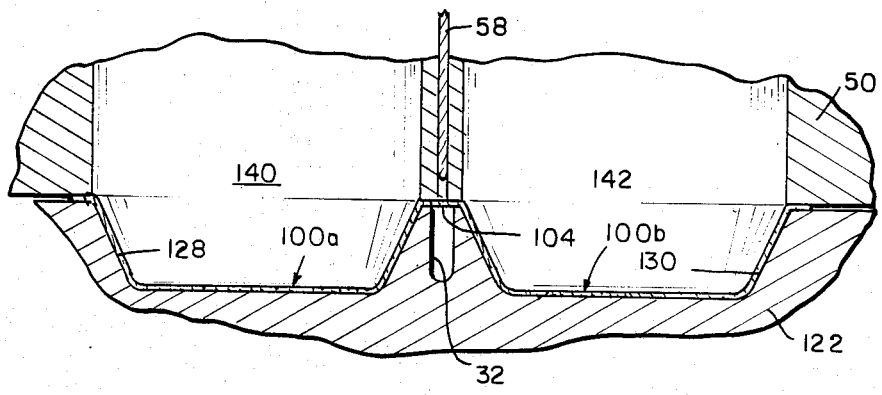
FIG. 9 is a side elevation view of the apparatus of FIG. 8 showing containers after formation.
Figure 10:
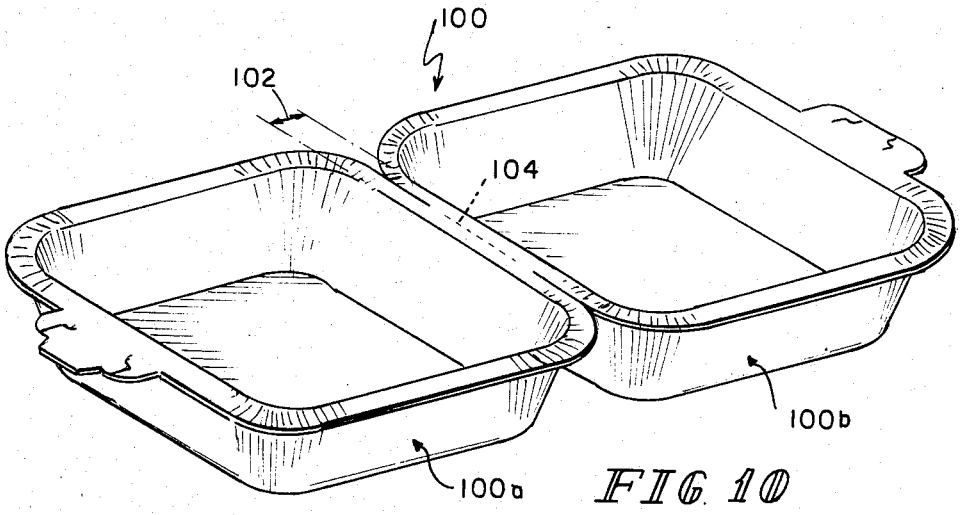
FIG. 10 is a perspective view of the clamshell container assembly formed using the apparatus of FIGS. 8 and 9.

In another embodiment of the invention illustrated in FIGS. 8–10, those elements referenced by numbers identical to those in FIGS. 1–7 perform the same or similar function. In the embodiment of FIGS. 8–10, the apparatus of the present invention has been configured to produce a clamshell-container assembly 100 of the type used to package sandwiches or the like as shown in FIG. 10.

In particular, female die assembly 122 includes first and second container forming cavities 128, 130 and the companion male die sections 140, 142 are configured to form a pair of "square-like" deep-drawn containers 100*a* and 100*b* during a simultaneous drawing operation. Prior to formation of the clamshell-container assembly 100, knife blade 58 is actuated to press a central portion of blank 12 into the material-receiving cavity 32 as shown in FIG. 8 to provide excess material for use in the drawing operation. The material-receiving cavity 32 is emptied of the excess paperboard material during the simultaneous formation of the interconnected adjacent containers 100*a, b* as illustrated in FIG. 9. Referring particularly to FIG. 10, it will be appreciated by those skilled in the art that the interconnected containers 100*a, b* are in closer proximity one to another than was heretofore possible using conventional presses and pressing techniques. The width dimension 102 of the common region 104 is advantageously decreased as a result of the present invention since the excess paper in the material-receiving cavity acts to lessen strain on the drawin paper material during container formation, thereby reducing the incidence of rupture or tearing of the blank of paperboard material.

Although the invention has been described in detail with reference to certain preferred embodiments, variations and modifications exist within the scope and spirit of the invention as described and defined in the following claims.

What is claimed is:

1. A press die system for substantially simultaneously forming at least two containers with a common region extending therebetween from a single sheet of paperboard material or the like, the press die system comprising a female die assembly formed to include a first container-forming cavity, a second container-forming cavity in spaced relation to the first cavity, and a paperboard material-receiving cavity situated between the first and second container-forming cavities, blade means confronting the paperboard-receiving cavity for pressing a portion of the sheet into the material-receiving cavity prior to formation of the at least two interconnected containers to provide a reservoir of excess paperboard material for use in forming the at least two interconnected containers, and male die means for substantially simultaneously pressing the single sheet into the first and second container-forming cavities to form the two interconnected containers causing paperboard material placed in the material-receiving cavity by the blade means to be drawn therefrom toward at least one of the container-forming cavities during operation of the male die means so that common regions interconnecting adjacent containers remain substantially intact and untorn during formation of the interconnected containers.

2. The die system of claim 1, wherein the blade means and the material-receiving cavity cooperate during operation of the male die means to form a hinged section in the common region extending between two adjacent containers so that one container can be folded about an axis over an adjacent container to provide a clamshell container assembly for receiving articles.

3. The die system of claim 2, wherein the material-receiving cavity is a transverse slot extending in the direction of the folding axis.

4. The die system of claim 1, further comprising draw ring means for gripping the sheet of paperboard material during operation of the male die means and means for movably connecting the draw ring means to the male die means.

5. The die system of claim 1, wherein the blade means includes a knife blade for pushing a portion of the sheet of paperboard material into the material-receiving cavity and means for actuating the knife blade to project into the material-receiving cavity and retract therefrom prior to operation of the male die means.

6. The die system of claim 1, wherein the female die assembly includes a first drawing surface interconnecting the first container-forming cavity and the material-receiving cavity and a second drawing surface interconnecting the second container-forming cavity and the material-receiving cavity, and further comprising draw ring means for holding the sheet material against both of the drawing surfaces after the material is pressed into the material-receiving cavity and during operation of the male die means and means for movably connecting the draw ring means to the male die means.

7. The die system of claim 6, wherein the male die means is configured to cause paperboard material placed in the material-receiving cavity to be drawn between the draw ring means and each of the first and second drawing surfaces and into respective first and second container-forming cavities.

8. A press die system for forming a pair of deep drawn paperboard containers with a hinge section therebetween such that one container can be folded about an axis over the other container to provide a clamshell container for receiving articles, said die system comprising a female die section for each container, said die sections being disposed in close proximity with a common region therebetween defining a hinged section, said region having a slot formed therein extending in the direction of said axis, a male die section confronting each female die section, a press for providing relative movement between the male and female die sections to form the containers, a draw ring substantially surrounding the die sections for holding the paperboard during the drawing process, a knife blade for pushing the paperboard into said slot, means for movably connecting the knife blade to the press so that the knife blade is movable relative to the male die section, and actuating means carried by the press for moving said knife blade into said slot to form the hinge section and provide excess paperboard, said actuating means being operable to withdraw said knife blade from said slot before said male and female die sections engage to draw the containers substantially simultaneously, said draw ring being carried by said press to hold the paperboard after the knife blade engages the slot and during the drawing by the male and female sections.

9. A press die system for drawing a pair of deep drawn paperboard containers joined together by hinge section so that one container can be folded about an axis over the other container to provide a clamshell container assembly, said die system comprising a press platen, a pair of female die sections carried by said press platen, a drawing surface bounding said female die sections and providing a common drawing surface between said sections, said drawing surface having a transverse slot formed therein extending in the direction of said folding axis, a cooperating press platen, a knife blade for pushing paperboard downwardly into said slot to form said hinge section and to provide excess material for the subsequent drawing operation, first means for movably connecting the knife blade to the cooperating press platen, the first means including means for actuating said knife blade to project into said slot and to retract therefrom prior to the drawing step, a draw ring for holding the paperboard against said drawing surface after the material is pushed into said slot and during the drawing operation, second means for movably connecting the draw ring to the cooperating press platen, and a pair of male die sections carried by said cooperating press platen to engage said female die sections to form said pair of containers substantially simultaneously and to draw excess material from said slot.

10. A method of simultaneously forming adjacent containers with a common region extending therebetween in a single blank, the method comprising the steps of positioning a single blank on a female die assembly formed to include a first container-forming cavity, a second container forming cavity in spaced-relation to the first container-forming cavity, and a material-receiving cavity situated between the first and second container-forming cavities.

pushing a portion of the blank into the material-receiving cavity to provide a reservoir of excess blank material for use in a subsequent drawing operation, holding the blank between a draw ring and the female die assembly, and moving a male mold section into engagement with the female mold section to draw blank material from the material-receiving cavity through a passageway between the draw ring and the female mold section so that excess blank material is conducted from the material-receiving cavity toward at least one of the container-forming cavities during movement of the male mold section and the interconnected adjacent containers are formed substantially simultaneously without tearing or otherwise damaging the common region therebetween.

11. The method of claim 10, wherein the pushing step comprises the step of forming a hinged section in the common region extending between two adjacent containers so that one container can be folded about an axis of an adjacent container to provide a clamshell container assembly for receiving articles.

12. The method of claim 10, wherein the pushing step comprises the steps of providing a knife blade configured to extend into the material-receiving cavity, and projecting the knife blade into the material-receiving cavity to deposit blank material in the material-receiving cavity.

13. The method of claim 12, wherein the pushing step further comprises the step of retracting the knife blade from the material-receiving cavity prior to both of the holding and moving steps.

* * * * *